United States Patent [19]

Uetrecht

[11] 4,218,950

[45] Aug. 26, 1980

[54] ACTIVE LADDER FILTER FOR VOICING ELECTRONIC MUSICAL INSTRUMENTS

[75] Inventor: Dale M. Uetrecht, Cincinnati, Ohio

[73] Assignee: Baldwin Piano & Organ Company, Cincinnati, Ohio

[21] Appl. No.: 33,097

[22] Filed: Apr. 25, 1979

[51] Int. Cl.[3] ..... G10H 1/12; G10H 1/16

[52] U.S. Cl. ..... 84/1.19; 84/DIG. 9; 179/1 A; 179/1 D; 179/1 M; 179/1 P; 307/233 R; 307/295; 328/167; 330/147; 330/306; 330/310; 333/172

[58] Field of Search ..... 84/1.11-1.13, 84/1.19, 1.21, 1.24, DIG. 9, DIG. 10; 179/1 A, 1 D, 1 F, 1 M, 1 P; 307/229, 233 R, 295; 328/167; 330/107, 109, 147, 291, 294, 302, 306, 310; 333/172

[56] References Cited

U.S. PATENT DOCUMENTS

| | | | |
|---|---|---|---|
| Re. 20,825 | 8/1938 | Smiley | 84/1.21 |
| 1,956,350 | 4/1934 | Hammond | 84/1.21 X |
| 2,139,023 | 12/1938 | Kock | 84/1.21 |
| 2,148,478 | 2/1939 | Kock | 84/1.21 X |
| 2,233,948 | 3/1941 | Kock | 84/1.21 X |
| 2,571,141 | 10/1951 | Knoblaugh et al. | 84/1.21 X |
| 3,321,567 | 5/1967 | Wayne, Jr. et al. | 84/1.13 |
| 3,390,223 | 6/1968 | Wayne, Jr. | 84/1.24 |
| 3,538,805 | 11/1970 | Uetrecht | 84/1.11 |
| 3,550,027 | 12/1970 | Uetrecht | 330/291 |
| 3,948,139 | 4/1976 | Melcher et al. | 84/1.19 |
| 3,960,043 | 6/1976 | Brand | 84/1.19 |
| 4,050,343 | 9/1977 | Moog | 84/1.19 X |
| 4,080,861 | 3/1978 | Wholahan | 84/1.24 |
| 4,134,321 | 1/1979 | Woron | 84/1.19 X |

*Primary Examiner*—Stanley J. Witkowski
*Attorney, Agent, or Firm*—Frost & Jacobs

[57] ABSTRACT

A multiple-stage active RC distributed filter having multiple inputs and a single output for producing filtering of large groups of notes for tone coloration in electronic musical instruments. Output signals from the keying circuits may be applied to selected input stages of the filter through a resistor matrix to produce the desired tone coloration. Voicing may be further modified by one or more compensation networks at the filter output.

6 Claims, 4 Drawing Figures

ACTIVE LADDER FILTER FOR VOICING ELECTRONIC MUSICAL INSTRUMENTS

BRIEF SUMMARY OF THE INVENTION

The present invention relates generally to electronic musical instruments, and more particularly to a multiple-stage active RC distributed filter for producing specific timbres from complex wave shapes.

Various techniques have been suggested for producing desired tone characteristics from electronic musical instruments. For example, a complex waveform may be synthesized from individual harmonics as shown in U.S. Pat. No. 1,956,350 (Hammond) and earlier Cahill systems. A sinusoidal wave consisting chiefly of the first harmonic, or fundamental, may be distorted in wave shape to contain many harmonics as in U.S. Pat. No. Re.20,825 (Smiley). Octavely related sawtooth waveforms containing a complete series of harmonics can be combined out-of-phase to produce square waves having only odd harmonics as in U.S. Pat. No. 2,148,478 (Kock). Combinations of complex waveforms having different fundamental frequencies can be transmitted through formant filter circuits having various transmission characteristics to give a wide variety of musical tone colors as in U.S. Pat. Nos. 2,139,023 and 2,233,948 (Kock). Octavely related square waveforms may be added together to give staircase approximations to sawtooth waveforms as in U.S. Pat. No. 2,571,141 (Knoblaugh and Jordan). Individual square waves can be converted to sawtooth waveforms as shown by U.S. Pat. No. 3,321,567 (Munch and Scherer). U.S. Pat. No. 3,390,223 (Wayne) discloses the production of desired complex tone spectra through the combined action of a set of very narrow band-pass filters on complex tone-wave inputs such as sawtooth waves. Finally, U.S. Pat. No. 3,538,805 to the present inventor shows a passive RC distributed filter to which groups of adjacent tone signals are introduced at diverse sections of the filter, in contrast to the aforementioned U.S. Pat. No. 2,233,948 in which an entire scale of tone waveforms was transmitted through the same filter. While this inventor's earlier distributed filters provided desirable voicing, the present invention seeks to improve transmission characteristics and rejection of unwanted harmonics, low-frequency intermodulation distortion and wide band noise.

The multiple-stage active RC distributed filter of the present invention provides improved rejection of not only undesirable upper harmonics, but also increased rejection of frequencies below the fundamental frequency, thereby significantly decreasing intermodulation distortion and increasing isolation between and among the filter stages. In one embodiment of the present invention, the active ladder filter is utilized to obtain a sine wave from a square wave for flute voicing in an electronic organ. In another embodiment, the filter modifies a sawtooth wave for diapason voicing. Finally, for more complex waveforms, specific harmonics may be chosen and their relative amplitude levels adjusted through a resistor matrix connected between the primary signal source producing rectangular or sawtooth waves and the appropriate filter stages. This arrangemet permits realistic synthesis of such complex tones as piano, harpsichord, etc.

DETAILED DESCRIPTION

Figure 1:
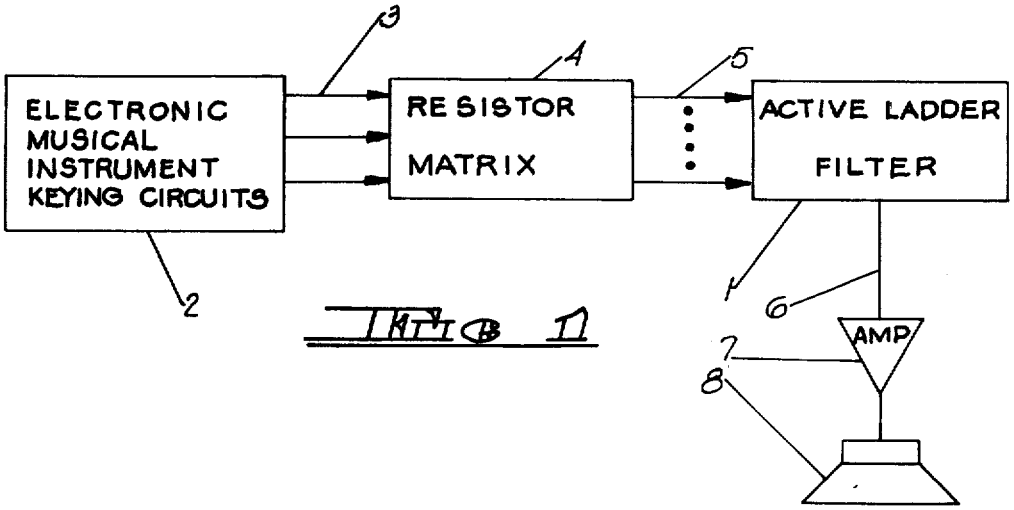
FIG. 1 is a functional block diagram of the active ladder filter of the present invention in combination with a resistor matrix within an electronic musical instrument.

FIG. 1 illustrates the active ladder filter 1 of the present invention within a combination of operating parts of an electronic musical instrument such as an organ, electronic piano, etc. Keying circuits 2 provide tone signals, one of which is shown at 3, which are applied through resistor matrix 4, producing one or more outputs, one of which is shown at 5, which are individually applied to selected input stages of active ladder filter 1. The output 6 of active ladder filter may be applied through an appropriate amplifier 7 as required to drive a loudspeaker 8. A more detailed description of an electronic musical instrument and its keying circuits 2 may be obtained by reference to copending application Ser. No. 33,096 filed Apr. 25, 1979 by David A. Bunger and Dale M. Uetrecht entitled "Electronic Piano", and assigned to common assignee Baldwin Piano and Organ Company.

Figure 2:
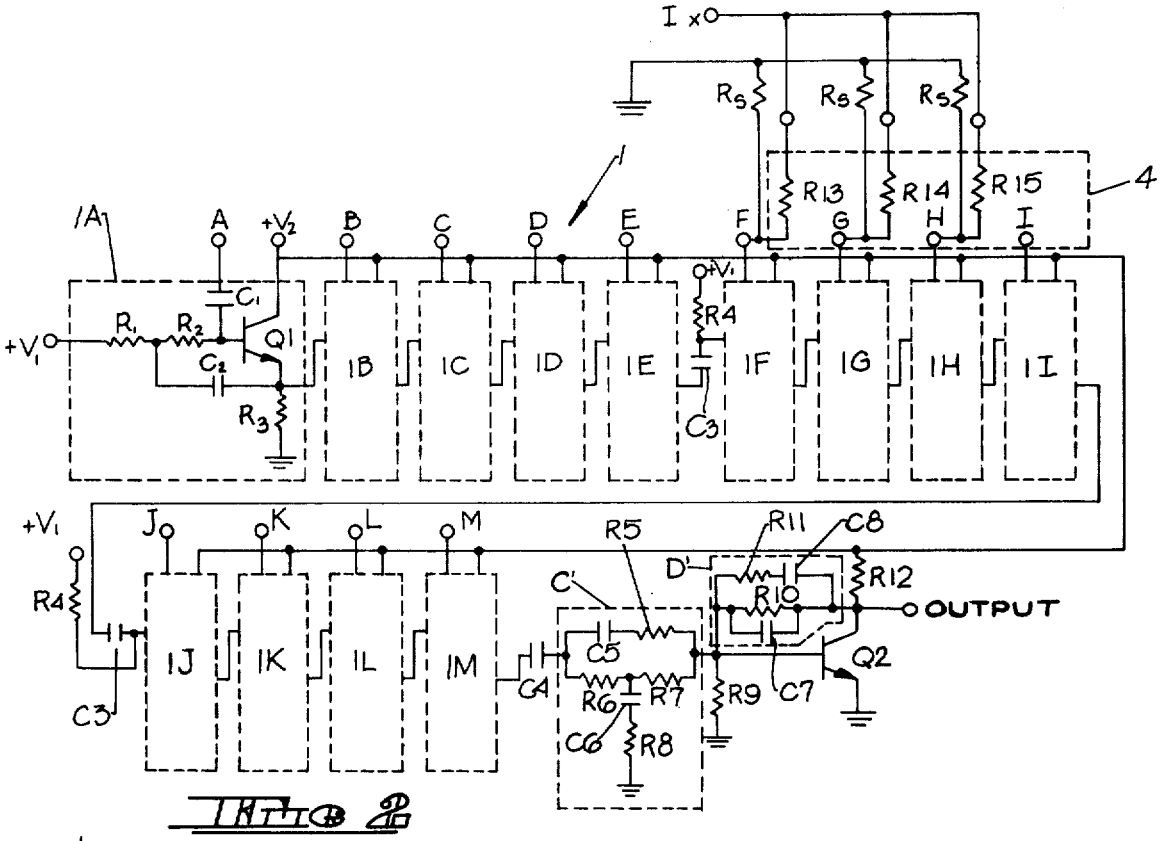
FIG. 2 is a schematic diagram, partly in functional block diagram form of typical filter stages cascaded to form the distributed ladder filter of the present invention.

FIG. 2 illustrates a schematic diagram, partly in block diagram form, of the active ladder filter 1 of the present invention. Filter 1 comprises a plurality of cascaded filter sections 1A–1M, filter stage 1A being shown in detail as representative of all filter stages. Each filter stage contains an input A–M for introducing signals to the filter stage, and an output for conducting signals to the next stage. The output of the last filter stage, illustrated in FIG. 2 as stage 1M for purposes of an exemplary showing, is connected to one or more compensation stages C and D which are utilized to tailor the overall frequency response of the system for specific types of tone characteristics, as will be explained in more detail hereinafter.

Filter stage 1A, which is representative of all filter stages, comprises an input terminal A connected to the base of emitter follower amplifier transistor Q1 through coupling capacitor C1. The base of transistor Q1 is also connected to voltage source $+V_1$ through the series combination of resistors R1 and R2. The collector of transistor Q1 is connected to voltage source $+V_2$. The emitter of transistor Q1 supplies the output for the filter stage, and is also connected to ground through resistor R3 and to the junction of resistors R1 and R2 through capacitor C2. This arrangement thus forms a bridged T filter having characteristics similar to the bridged T filter illustrated in my U.S. Pat. No. 3,550,027, issued Dec. 22, 1970.

The output from the emitter of transistor Q1 in filter stage 1A is applied through a corresponding resistor R1 in filter stage 1B. Thus in succeeding filter stages, resistor R1 is connected to the previous stage output, rather than solely to a fixed supply source. Although for purposes of an exemplary showing, 13 filter stages 1A–1M are employed in the active ladder filter of the present invention, any number of filter stages may be utilized as required for particular tone coloration. It will also be observed that the output of filter stage 1E is coupled to the input of filter stage 1F through coupling capacitor C3, and that the input to filter stage 1F is connected to supply voltage $+V_1$ through a resistor R4. This arrangement maintains the DC bias of subsequent filter stages. A similar arrangement is utilized between filter stages 1I and 1J. It will be further understood that additional bias compensation networks similar to the combination of resistor R4 and capacitor C3 may be utilized between successive filter stages as required.

Additional compensation networks designated C' and D' in FIG. 2 may also be provided following the last filter stage 1M to tailor the overall frequency response for desired characteristics. As illustrated in FIG. 2, the output from final filter stage 1M is coupled through capacitor C4 to the input of compensation network C'. Compensation network C' comprises the parallel combination of a series connected capacitance C5 and resistance R5, and the series connected combination of resistor R6 and resistor R7. The junction of resistors R6 and R7 is connected to ground through the series combination of a capacitor C6 and resistor R8, thus forming a T filter network. The output of compensation network C' is connected to ground through resistor R9, to the base of amplifying transistor Q2, and to the input of compensation network D'. Compensation network D' which is connected between the base and collector of transistor Q2 comprises the parallel combination of capacitor C7, resistor R10, and the series combination of resistor R11 and capacitor C8. A resistor R12 connected between the collector of transistor Q2 and positive supply voltage $+V_2$ supplies bias current for the transistor. The output of the filter is taken from the collector of transistor Q2.

Figure 3:
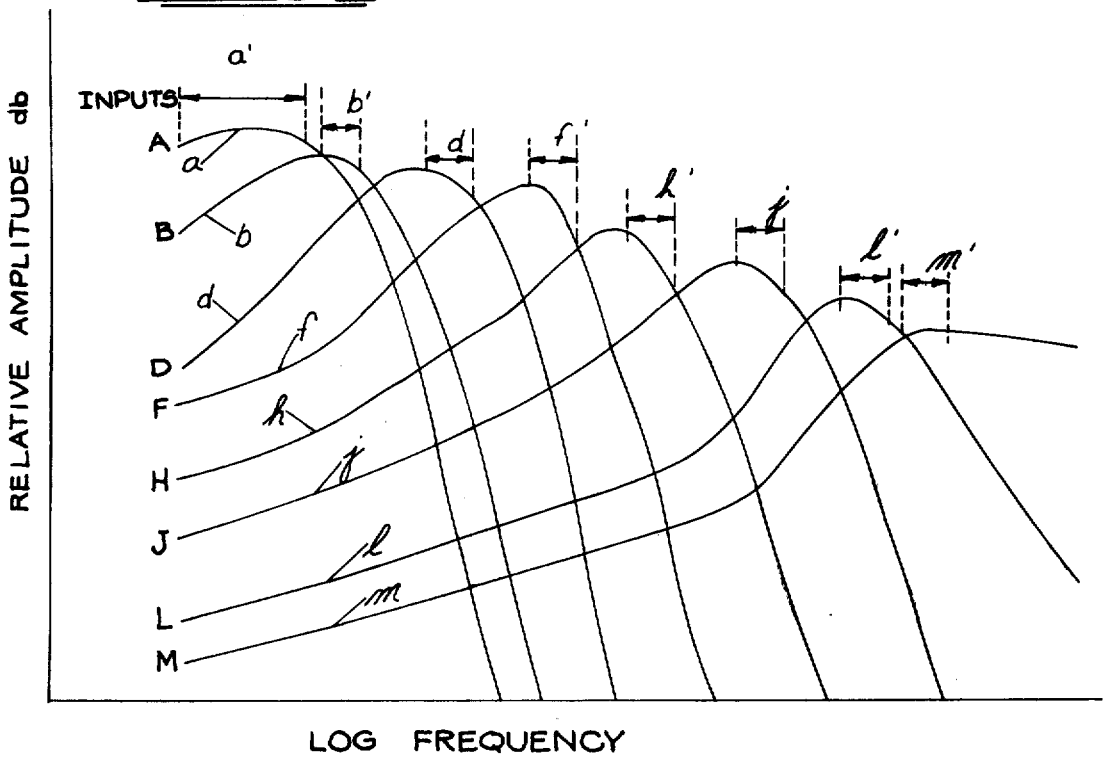
FIG. 3 is a graphical representation of the frequency response characteristics of the filter of FIG. 2 for input at different points.

FIG. 3 illustrates a graphical representation of the frequency response characteristics of filter 1 for a constant input signal applied to the input of selected filter stages, with all inputs being connected to a source impedance having a value less than $(R_1+R_2)/10$. For example, curve a is obtained for a constant input applied to input terminal A of filter stage 1A, curve b is obtained for a constant input applied to input terminal B of filter stage 1B, etc. In other words, the frequency response curves associated with constant input signals applied to the input of filter stages 1C, 1E, 1G, 1I, and 1K have been omitted for clarity, since the other curves illustrate the general frequency response of the filter stages. In general, it will be observed that the curves exhibit bandpass characteristics with peaking for each filter stage, the pass band of each stage and amount of peaking being adjustable by proper scaling of circuit components R1, R2, C1 and C2 for each stage as is wellknown in the art. For example, the center frequency for each curve will be determined by proper selection of $\sqrt{R_1R_2C_1C_2}$ while the Q of the circuit is generally determined by the ratio chosen for capacitors $C_1$ and $C_2$.

It will be observed that the low-frequency rejection characteristics of the filter greatly attenuate both low-frequency intermodulation distortion products and low-frequency noise, while the high frequency rejection characteristics of the filter exhibit improved upper harmonic rejection due to the sharp roll-off at higher frequencies. The particular frequency characteristic available will depend on the individual input A–M chosen to modify the characteristics of pulse, square or sawtooth input signals transmitted by the keying circuits 2.

It will also be observed that the upper envelope of the family of curves illustrated in FIG. 3 exhibits some bass boost and slight high-frequency roll-off. This is due to the frequency characteristics of compensation networks C' and D', which perform the function of tailoring the overall frequency response of the system for particular tone characteristics such as flute tone production, for example. Utilizing the arrangement shown, the frequency range of the fundamental square wave applied to each input A–M as a flute voice filter is illustrated by the frequency ranges designated a'–m' respectively.

Transistor Q2 functions as an amplifier for the filtered signals for further use in the electronic musical instrument system, and can be used in association with additional amplifiers 7 to provide sufficient amplitude for driving loudspeaker 8 as shown in FIG. 1.

Figure 4:
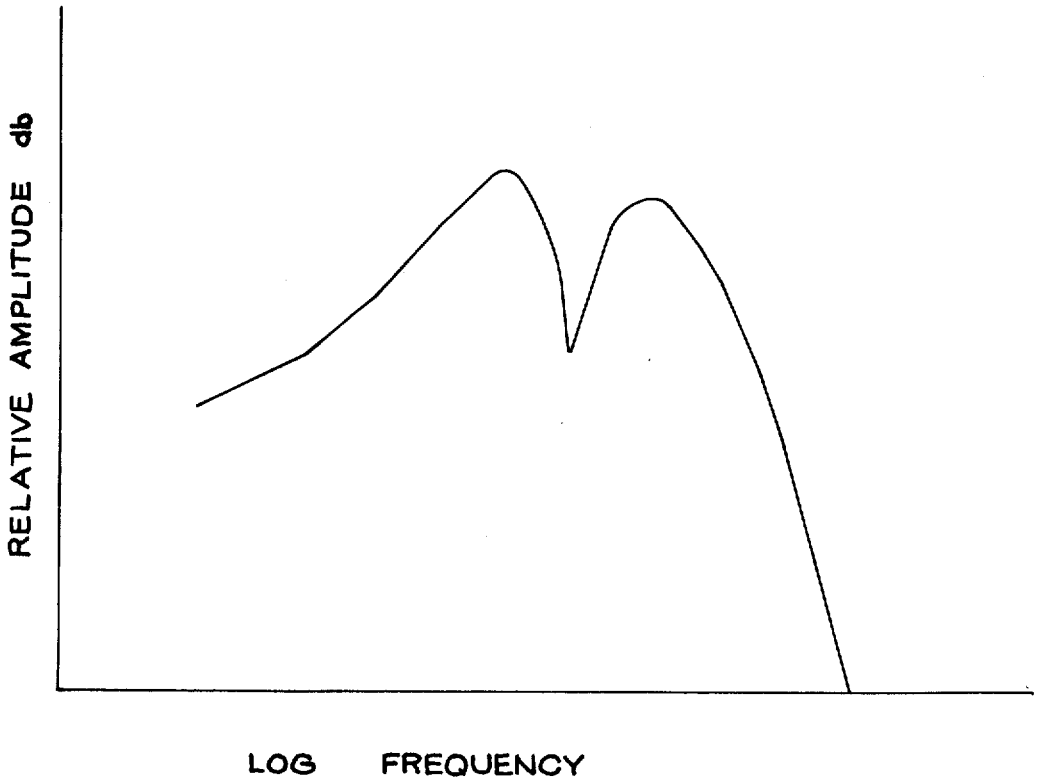
FIG. 4 is a graphical representation of one exemplary filter response with the input signal applied to three selected inputs through a resistor matrix.

FIG. 4 illustrates the frequency characteristics for a notch filter obtained by applying a tone source signal through resistors to selected inputs of filter 1. For example, the response curve of FIG. 4 was obtained by applying to input IX a constant amplitude input signal which is directed to respective filter input terminals F, G, and H through a matrix of selected resistors R13, R14 and R15. As illustrated in FIG. 2, $R_s$ represents the driving impedance of the input signal source. The particular filter characteristics obtainable using this technique will depend upon the characteristics of the particular filter stages and compensation networks, and the relative values of the scaling resistors making up the resistor matrix 4. It should be noted that the source impedance, $R_s$, driving each input should generally be less than $(R_1+R_2)/10$. Unused inputs will normally be grounded. It will thus be understood that a wide variety of complex waveforms corresponding to complex tones such as piano, harpsichord, etc. may be synthesized in this manner to more closely emulate acoustical musical instrument sounds.

It will be further understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. A multiple input active ladder filter for voicing electronic musical instruments having one or more signal sources producing output signals of predetermined frequency, amplitude and phase, said filter comprising a plurality of cascaded active filter stages, each stage having a first input, a second input, and an output, said first input being connected to said output of a preceeding filter stage, each of said stages having a predetermined bandwidth and center frequency, and a resistor matrix for coupling the outputs of selected tone sources to selected second inputs of said filter stages, said matrix comprising a plurality of resistors, individual ones of said resistors connecting the output of a selected signal source with a plurality of selected second filter stage inputs, said stages operating to combine signals introduced at said second inputs.

2. The filter according to claim 1 wherein each of said filter stages comprises:

a substantially unity gain amplifier having an input and an output, said amplifier output comprising said stage output;

a capacitor connected between said second input and said amplifier input;

a first resistor and a second resistor connected in series between said first input and said amplifier input; and a capacitor connected between said amplifier output and the junction of said first and second resistors.

3. The filter according to claim 2 wherein said amplifier comprises a transistor having a base forming said amplifier input, an emitter forming said amplifier output, and a collector connected to a voltage source, said amplifier further including a third resistor connected between said emitter and ground.

4. The filter according to claim 1 wherein said filter includes one or more compensation networks connected to said stage output of the last stage of said filter, said compensation networks providing enhancement of low frequency signals and attenuation of high frequency signals.

5. The filter according to claim 4 wherein said compensation network comprises:

a coupling capacitor connected to said last stage output;

an amplifier having an input and an output;

a T filter connected between said coupling capacitor and said amplifier input, said T filter comprising a first resistor and a second resistor connected in series, and the series combination of a capacitor and a resistor connected between the junction of said first and second resistors and ground;

a resistor and capacitor connected in series between said coupling capacitor and said amplifier input; and a resistor and capacitor connected in series, a capacitor, and a resistor connected in parallel between said amplifier input and said amplifier output.

6. In an electronic musical instrument having one or more tone sources, the improvement in combination therewith comprising a multiple input active ladder filter for filtering the output of one or more of said tone sources to produce desired tone coloration, said filter including a plurality of cascaded active filter stages, each stage having a first input, a second input, and an output, said first input being connected to said output of a preceding stage, each of said stages having a predetermined bandwidth and center frequency, and a resistor matrix for coupling the outputs of selected tone sources to selected second inputs of said filter stages, said matrix comprising a plurality of resistors, individual ones of said resistors connecting the output of a selected signal source with a plurality of selected sound filter stage inputs, said stages operating to combine signals introduced at said second inputs.

* * * * *